United States Patent [19]

Swift

[11] Patent Number: 4,697,833

[45] Date of Patent: Oct. 6, 1987

[54] SECURITY SEAL

[76] Inventor: Allan W. Swift, 22 Edgewater Dr., Denville, N.J. 07834

[21] Appl. No.: 790,622

[22] Filed: Oct. 23, 1985

[51] Int. Cl.[4] ..... B65D 63/10

[52] U.S. Cl. ..... 292/318; 24/16 P; 24/16 B; 292/322

[58] Field of Search ..... 292/318, 319, 322, 321, 292/320; 24/30.5 P, 16 P, 16 B, 662, 681

[56] References Cited

U.S. PATENT DOCUMENTS

| | | | |
|---|---|---|---|
| Re. 31,541 | 3/1984 | Wood | 24/30.5 P X |
| 1,001,878 | 8/1911 | Miller | 292/318 |
| 1,178,758 | 4/1916 | Sondley | 292/318 |
| 1,682,396 | 8/1928 | Miller | 292/318 |
| 2,002,856 | 5/1935 | Hope | 292/322 |
| 2,131,347 | 9/1938 | Fenton | 24/681 |
| 2,242,352 | 5/1941 | Fenton | 24/681 |
| 2,300,292 | 10/1942 | Jones | 24/681 |
| 2,312,443 | 3/1943 | Reiter | 24/681 X |
| 4,441,233 | 4/1984 | Swift | 24/30.5 P X |
| 4,616,953 | 10/1986 | Gomes | 24/662 X |

FOREIGN PATENT DOCUMENTS

| | | | |
|---|---|---|---|
| 1266175 | 5/1961 | France | 24/681 |

*Primary Examiner*—Lloyd A. Gall

*Attorney, Agent, or Firm*—Carella, Byrne, Bain & Gilfillan

[57] ABSTRACT

A security seal of the type comprising a shackle and a locking mechanism formed of a single piece of resilient plastic and comprising a shouldered stud and a socket having resilient stud engaging means positioned on the shackle in spaced relation to each other, in which the socket comprises a relatively thin flexible wall having an aperture with means for receiving the stud in locking engagement, and a second protective wall surrounding the first wall in spaced relation thereto. The flexibility of the first wall allows a greater interference between the shoulder of the stud and the locking means of the socket, providing a greater overlap of the locking surfaces, while providing less insertion force, and the surrounding wall deters attempts to release the stud from the socket without leaving evidence of tampering.

6 Claims, 7 Drawing Figures

SECURITY SEAL

BACKGROUND OF THE INVENTION

In the art of security seals, it is common to provide a one piece seal formed of injection molded plastic and having a shackle with fastener portions at spaced positions thereon, said fasteners being of the stud and socket type with the components so dimensioned that when assembled with each other, they cannot be separated without leaving evidence of tampering.

One disadvantage of such seals is the fact that they can sometimes be defeated by skillfull manipulation of the locking mechanism by the insertion of a probe through the socket wall. Another disadvantage is the fact that to provide a secure locking engagement, there must be considerable interference between the stud shoulder and the locking mechanism of the socket, making manual assembly difficult. Assembly of such seals can be fatiguing to personnel who are required to assemble hundreds of seals per day.

SUMMARY OF THE INVENTION

This invention provides a security seal formed of a single piece of injection molded plastic, comprising a shackle and fastener members positioned in spaced relation on the strap, said fastener members being shaped and dimensioned for locking engagement when the shackle is bent to enable the fastener portions to be engaged.

The fastener portions comprise a rigid stud with a locking shoulder, and the socket comprises a central portion having a wall forming an opening, with means associated with the wall to receive the stud in locking engagement. In the preferred embodiment of the invention, the wall is relatively flexible laterally to allow easy insertion of the stud. A second wall surrounds the first wall in close spaced relation thereto. The second wall may be more rigid than the first wall, so as to deter attempts to release the stud from the socket by the insertion of a probe through the walls.

DESCRIPTION OF THE ILLUSTRATED EMBODIMENTS

Figure 1:
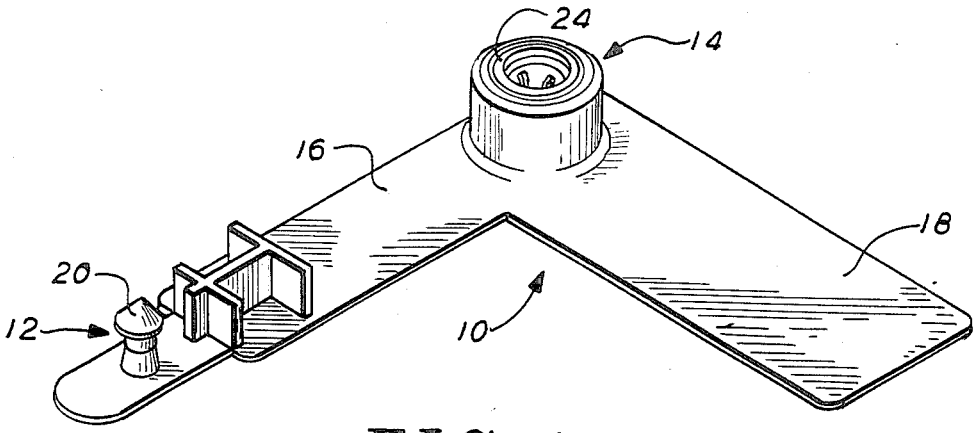
FIG. 1 is a perspective view of a seal embodying the features of the invention.
Figure 2:
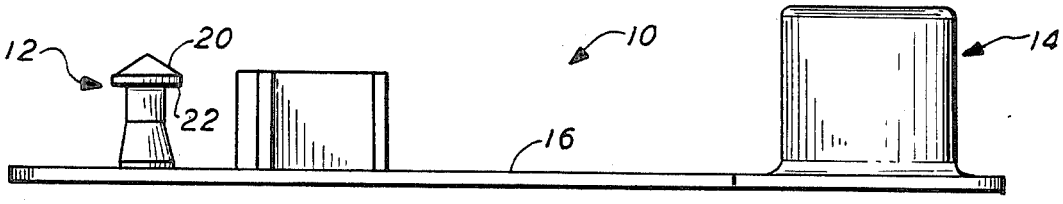
FIG. 2 is a view in side elevation of the seal of FIG. 1.
Figure 3:
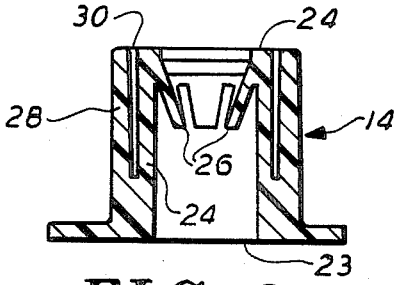
FIG. 3 is a view in section of the socket portion of the seal of FIG. 2.
Figure 4:
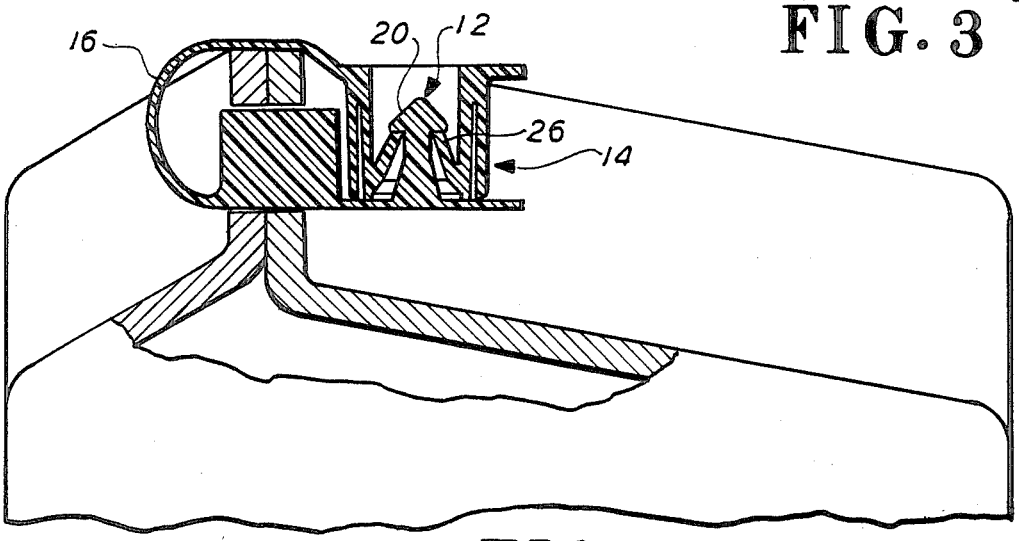
FIG. 4 is a view in section of the seal of FIGS. 1–3 after assembly with an article to be sealed.

Referring to FIGS. 1–4 of the drawing, there is illustrated a security seal 10, preferably formed of a single piece of injection molded plastic, which comprises a stud 12 and a socket 14 disposed in spaced relation on a shackle 16. An elongated identification tag portion 18 may be provided which extends laterally from the shackle.

The stud 12 may have the usual configuration of such devices, comprising an enlarged head 20 on the end with an abrupt shoulder 22 facing away from the end.

To receive the stud in locking engagement, the socket 14 comprises a base portion 23 and a first upstanding wall 24 which may be circular, extending upwardly from the base, with a series of resilient locking fingers 26 formed on the inner surface thereof, said fingers being inclined inwardly and rearwardly away from the top of the wall. The fingers are dimensioned and positioned to provide an entrance for the stud 12 to receive the abrupt shoulder of the stud behind the ends of the fingers in locking engagement in the usual manner of devices of this type.

A second upstanding wall 36 is provided on the base portion, said second wall being disposed closely around the first wall, forming an intervening peripheral space 30, and extends upwardly from the shackle to the same height as the inner wall 24 for a purpose to appear hereinafter.

In the illustrated embodiment the inner wall 24 is thinner and therefore more resilient than is customary with sockets of this type, which allows the difference in diameter between the enlarged head of the stud and the socket entrance between the fingers 26 to be greater, thereby increasing the locking effectiveness of the assembly without increasing the insertion force required to push the stud into the socket.

For example, in a typical stud and socket of this type, such as is illustrated in my U.S. Pat. No. 4,441,233, the diameter of the head of the stud may be 0.188 inches, and the diameter of the opening formed by the ends of the resilient fingers may be 0.112 inches, resulting in an interference or overlap of 0.038 inches at each finger. However, in the embodiments of FIGS. 1–4, the diameter of the enlarged head of the stud is 0.200 inches and the diameter of the opening formed by the fingers is 0.110 inches, providing an interference of 0.045 at each finger. However, the insertion force of the embodiment of FIGS. 1–4 is less than the insertion force of the device shown in U.S. Pat. No. 4,441,233, in spite of the substantially greater interference between the stud and the socket fingers, because of the greater resilience of the inner wall 24 as compared with the wall of the socket 14 of the above mentioned patent, so that during insertion of the stud, the socket wall 24 is capable of radial expansion.

Tests have shown that the insertion force of the seal shown in U.S. Pat. No. 4,441,233 with stud and socket dimensions given above is about 20 pounds, whereas the seal disclosed herein, with the above dimensions, is only about 4–7 pounds.

The thinness and flexibility of the wall 24 would render the assembly susceptible to tampering, and therefore the outer wall 28 is provided around the inner wall. The outer wall 28 may be made as thick as desired, and provides a protective shield around the inner wall to resist attempts to defeat the seal by the insertion of a sharp object through the wall to release the fingers from the stud. The fact that the structure disclosed herein also provides for greater interference between the stud shoulder and the ends of the fingers also assists in preventing unauthorized and undetected opening of the seal, and the fact that the outer wall extends as high as the inner wall assists in preventing the insertion of a picking tool between the top of the socket and the portion of the shackle surrounding the stud.

Figure 5:
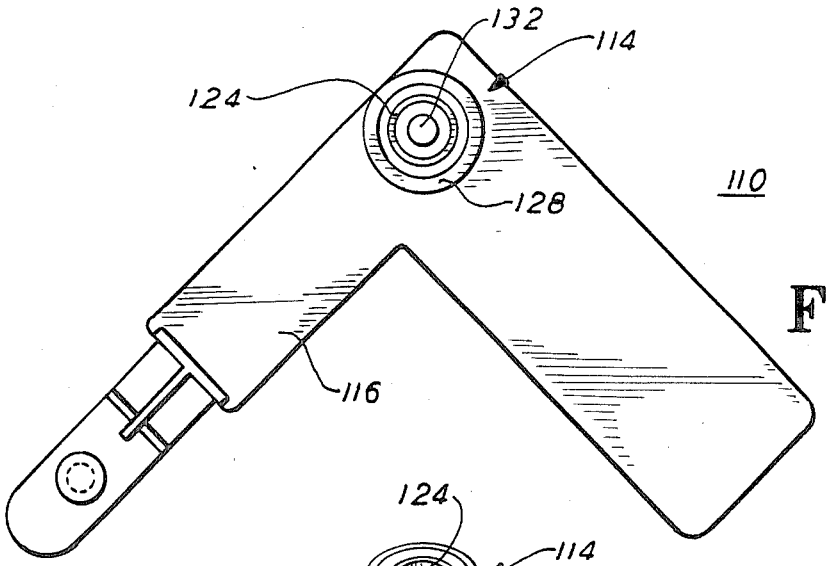
FIG. 5 is a top plan view of a seal embodying the features of the invention, having a modified form of socket.
Figure 6:
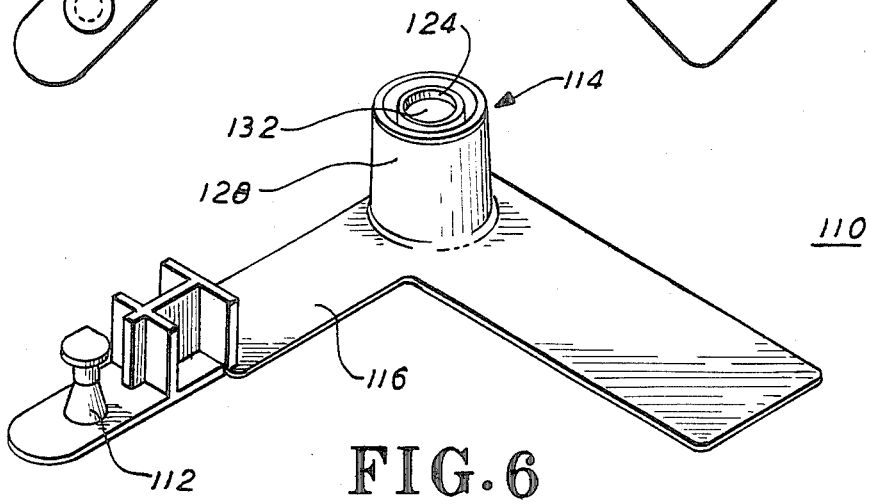
FIG. 6 is a perspective view of the seal of FIG. 5.
Figure 7:
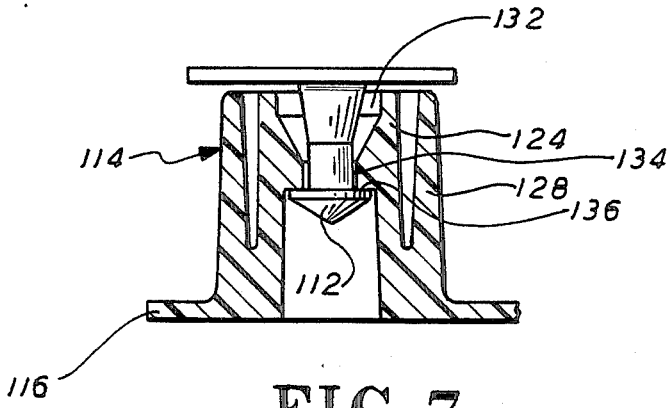
FIG. 7 is view in section of the socket of the seal of FIG. 5.

Referring now to FIGS. 5-7 of the drawing, there is illustrated a modified form of seal 110 embodying the features of the invention, which comprises a stud 112 and socket 114 disposed on a shackle 116 in the manner previously described. However, in the embodiment of FIGS. 5-7, the inner socket wall 124 is shaped to provide a stud-receiving aperture 132 which has a restricted opening 134 recessed therein which is dimensioned and positioned to allow the enlarged head of the stud to snap therethrough and lock behind the surface 136 surrounding the lower side of the opening.

The embodiment of FIGS. 5-7 is more economical to mold than the embodiment of FIGS. 1-4 since the socket has no resilient fingers. The interference or overlap between the enlarged head of the stud and the restricted opening may be adjusted to provide an acceptable insertion force. Although the insertion force of the seal of FIGS. 5-7 is somewhat greater than that of the seal of FIGS. 1-4, it is nevertheless acceptable for many applications, and yet has adequate overlap of the stud shoulder and the bottom surface of the opening after assembly to provide a secure locking action.

The outer wall 128 of the embodiment of FIGS. 5 and 6 may have any thickness required to provide adequate protection for the inner wall 124.

Since certain other changes apparent to one skilled in the art may be made in the herein described embodiments of the invention without from the scope thereof, it is intended that all matter con-tained herein be interpreted in an illustrative and not a limiting sense.

What is claimed is:

1. A security seal formed of a single piece of molded plastic and including a stud and a socket extending upwardly from a flexible strap and being shaped and dimensioned for locking non-separable engagement, said stud having an enlarged head with a rearwardly facing locking shoulder, said socket having an inner wall forming an opening for receiving the stud and means in the opening for receiving the enlarged head of the stud in locking engagement, and an outer wall disposed closely around the inner wall, said outer wall terminating in a distal end, said strap having a portion around the stud which is positioned to be contacted by the distal end of the outer wall when the stud and socket are engaged so as to thereby prevent tilting movement of the stud and socket in relation to each other and to restrict access to the locking means.

2. A security seal as set out in claim 1 in which the inner wall has a series of resilient fingers extending inwardly and downwardly from the upper end thereof forming a central aperture for receiving the stud, and said outer wall has substantially the same height as the inner wall.

3. In a security seal of the type formed of a single piece of molded plastic and comprising a stud and socket extending upwardly from a support and being shaped and dimensioned for locking non-separable engagement in which the socket comprises a circular wall extending upwardly from the support and is dimensioned and positioned to provide a stud-receiving opening at one end, and internal means in said end for receiving the stud in locking engagement, the improvement comprising a protective wall closely surrounding the socket and extending substantially to said end of the socket, the distal end of said wall being positioned for contact with a portion of the support around the stud when the stud and socket are assembled.

4. A security seal formed of a single piece of injection molded plastic, comprising a stud and a socket disposed in spaced relation on a flexible member so that the stud and socket may be moved into locking non-separable engagement, the stud comprising a shank having an enlarged head with a locking shoulder, said socket comprising a relatively flexible upstanding inner wall forming a central aperture for receiving the stud, resilient fingers inside the inner wall for receiving the enlarged head of the stud in locking engagement, the stud and socket being so dimensioned that peripheral expansion of the inner wall is necessary to facilitate manual engagement of the stud in the socket opening, and an outer wall closely surrounding the inner wall, there being sufficient space between the inner wall and the outer wall to allow expansion of the inner wall required to allow engagement of the stud therein without causing expansion of the outer wall, the distal end of the outer wall being positioned to engage a portion of the flexible member surrounding the stud when the stud and socket are disposed in locked engagement.

5. A security seal formed of a unitary piece of molded plastic and including a stud and a socket extending upwardly from a connecting strap and being adapted for locking non-separable engagement, said stud having an enlarged head with a rearwardly facing shoulder, said socket comprising a continuous wall extending upwardly from a support, said wall forming a central opening dimensioned to receive the stud, and means in the opening a predetermined distance from the top of the socket for receiving the enlarged head of the stud in locking non-separable engagement, said wall having an intervening peripheral space formed in the top thereof, said intervening peripheral space extending downwardly into the wall a distance at least equal to said predetermined distance, forming inner and outer wall portions in at least the upper portion of the wall, the upper end of the wall and a portion of the strap around the stud being positioned so as to be in abutting relation when the stud and socket are assembled into engagement.

6. A seal as set out in claim 5 in which the diameter of the stud and the diameter of the socket opening is such that radial expansion of the inner wall portion is required to allow engagement of the stud into the socket.

* * * * *